United States Patent [19]

Kameoka et al.

[11] 4,396,709

[45] Aug. 2, 1983

[54] METHOD OF IMPROVING ADHESION RESISTANCE OF SILVER HALIDE PHOTOGRAPHIC LIGHT-SENSITIVE MEDIUM FOR USE IN PRINTING

[75] Inventors: Kimitaka Kameoka; Yoshimi Ishigami, both of Kanagawa, Japan

[73] Assignee: Fuji Photo Film Co., Ltd., Kanagawa, Japan

[21] Appl. No.: 269,095

[22] Filed: Jun. 2, 1981

[30] Foreign Application Priority Data

Jun. 2, 1980 [JP] Japan ..... 55-74111

[51] Int. Cl.[3] ..... B03C 1/78

[52] U.S. Cl. ..... 430/539; 430/621

[58] Field of Search ..... 430/539, 621

[56] References Cited

U.S. PATENT DOCUMENTS

| | | | |
|---|---|---|---|
| 2,993,793 | 7/1961 | Beersmans et al. | 430/539 |
| 4,018,609 | 4/1977 | Lohmer et al. | 430/539 |
| 4,021,244 | 5/1977 | Nagatomo et al. | 430/539 |
| 4,146,398 | 5/1977 | Arase et al. | 430/539 |
| 4,266,010 | 5/1981 | Nagatomo et al. | 430/539 |
| 4,268,627 | 5/1981 | Sera et al. | 430/539 |

*Primary Examiner*—Jack P. Brammer

*Attorney, Agent, or Firm*—Sughrue, Mion, Zinn, Macpeak, and Seas

[57] ABSTRACT

The adhesion resistance of a silver halide photographic light-sensitive medium comprising a support, at least one emulsion layer provided on one side of the support and a backing layer provided on the other side can be improved by incorporating an acid-treated gelatin and a gelatin hardener containing therein a vinyl sulfone group into the backing layer.

20 Claims, No Drawings

METHOD OF IMPROVING ADHESION RESISTANCE OF SILVER HALIDE PHOTOGRAPHIC LIGHT-SENSITIVE MEDIUM FOR USE IN PRINTING

BACKGROUND OF THE INVENTION

The present invention relates to a method of improving the adhesion resistance of a silver halide light-sensitive medium for use in printing (hereinafter referred to as a "light-sensitive printing medium"). More particularly, it relates to a method of improving the adhesion resistance of a light-sensitive printing medium, which further improves the color-retention properties of a backing layer after development processing.

A light-sensitive printing medium generally comprises a plastic support, such as cellulose acetate and polyester films, a silver halide emulsion layer and a surface protective layer which are provided on one side of the support, and a backing layer composed of gelatin as a binder and dye, which is provided on the other side of the support.

Hydrophilic colloid layers composed mainly of gelatin, such as the foregoing surface protective layer and backing layer, have the disadvantage that they are greatly influenced by humidity and temperature; that is, they stretch and contract according to changes in humidity and temperature. This leads to reduction in the dimensional stability of a photographic light-sensitive medium. The poor dimensional stability of the photographic light-sensitive medium is a serious problem for the light-sensitive printing medium.

In order to provide photographic light-sensitive media having excellent dimensional stability, a method of softening the binder has been proposed. For example, a method of incorporating a polymer latex into the binder is known, as described in Japanese Patent Publication Nos. 4272/64, 17702/64 and 13482/68 and U.S. Pat. Nos. 2,376,005, 2,763,625, 2,772,166, 2,852,386, 2,853,457, 3,397,988, 3,411,911, 3,411,912 and 3,525,620.

Hydrophilic colloid layers composed of a binder containing therein a polymer latex, however, are increased in adhesive properties or sticking properties at high humidities, particularly in a high temperature and high humidity atmosphere. That is, when they come in contact with other members, they easily stick thereto. This phenomenon occurs between photographic light-sensitive media themselves or between the photographic light-sensitive medium and another member to come into contact therewith during the course of production, processing or storage of photographic light-sensitive media, and often creates various problems.

A method of preventing the easy bonding of the hydrophilic colloid layer (which is called in the art a method of improving the adhesion resistance of the hydrophilic colloid layer; therefore, the term "adhesion resistance" is used in the specification to mean an ability to resist such bonding) includes a so-called matting technique. This technique increases the coarseness of the surface of the colloid layer by incorporating thereinto fine particles of, for example, silica, magnesium oxide or polymethyl methacrylate having an average grain size of about 1 to 5 microns (hereinafter referred to as a "matting agent").

However, this matting technique has disadvantages. When the matting agent is incorporated into the colloid layer in an amount which provides sufficient adhesion resistance, the transparency of an image formed by development processing of the photographic light-sensitive medium is reduced. Furthermore, the granularity of the image is deteriorated, the sliding properties of the surface of the photographic light-sensitive medium are deteriorated, and the surface of the photographic light-sensitive medium is easily scratched.

A dye is incorporated into the backing layer of the light-sensitive printing medium in order to prevent halation and facilitate the distinction between both sides of the medium. The dye incorporated into the backing layer must be completely removed by development processing. With regard to the color-retention properties, it is said in the art that when the decolorization is insufficient, the color retention properties are poor. However, when decolorization is completely achieved, the color retention-properties are excellent. Accordingly, the term "excellent color retention-properties" is used in the specification to indicate that decolorization after development processing is performed completely.

The poor color-retention properties of the backing layer not only deteriorate the quality of the image after development processing, but also undesirably lengthen the exposure time required for printing the image formed on the light-sensitive printing medium to a printing plate.

SUMMARY OF THE INVENTION

An object of the present invention is to provide a method of improving the adhesion resistance of a light-sensitive printing medium without deterioration of the dimensional stability thereof.

Another object of the present invention is to provide a method of improving the adhesion resistance of a light-sensitive printing medium without deterioration of the color-retention properties thereof.

A further object of the present invention is to provide a light-sensitive printing medium having good dimensional stability, adhesion resistance and color-retention properties.

It has been found that the objects are attained by employing acid-treated gelatin as the gelatin for use in the backing layer and a compound containing a vinyl sulfone group as a gelatin hardener.

The present invention, therefore, provides a method of improving the adhesion resistance of a silver halide photographic light-sensitive medium for printing. The medium is comprised of: a support; at least one silver halide emulsion layer provided on one side of the support; and a backing layer provided on the other side of the support. The method comprises incorporating acid-treated gelatin and a gelatin hardener containing therein a vinyl sulfone group into the backing layer.

DETAILED DESCRIPTION OF THE INVENTION

The acid-treated gelatin as used herein is produced by a treatment using hydrochloric acid, etc., in the course of production from cholagen. The acid-treated gelatin is different from alkali-treated gelatin usually used in the photographic industry, which is produced by a treatment using lime, etc.

A process for the production of such gelatin and its properties are described in detail in Arther Veis: *The Macromolecular Chemistry of Gelatin*, Academic Press, pp. 187–217 (1964). The major distinction between acid-treated gelatin and alkali-treated gelatin resides in that the isoelectric point of the alkali-treated gelatin is pH 4.5 to 5.3, whereas that of the acid-treated gelatin is pH 6.0 to 9.5.

The acid-treated gelatin is generally produced from animal skin, particularly pig skin. It is also possible to use animal bones, such as cow bones. Of such acid-treated gelatins, an acid-treated gelatin produced from cow bones and having an isoelectric point of pH 6.0 to 7.5 is particularly preferably used in the invention.

The amount of the acid-treated gelatin used is preferably about 0.1 to 20 g per square meter of the backing layer, with the range of about 0.5 to 6 g per square meter being particularly preferred.

The incorporation of the acid-treated gelatin alone into the backing layer may deteriorate the color-retention properties after development processing although it improves the adhesion resistance. In accordance with the invention, however, a compound containing therein a vinyl sulfone group is used as a hardener for the acid-treated gelatin. This permits the improvement of not only adhesion resistance but also color-retention properties.

Preferred examples of such gelatin hardeners containing therein a vinyl sulfone group which can be used in the present invention are represented by formulae (I) to (IV):

$$[CH_2{=}CHSO_2{-}\underset{}{\overset{R_1}{\overset{|}{(CH)}}}_n]_m Z \qquad \text{(I)}$$

wherein $R_1$ is a hydrogen atom or a methyl group; Z is a linking group selected from the group consisting of

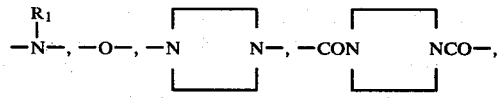

$-CONH(CH_2)_nCONH-$, and $-CH{=}CH_2$; where n is an integer of 0 to 6; and m is 1 or 2.

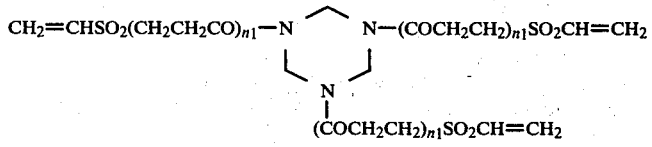

(II)

wherein $n_1$ is 0 or 1.

$$CH_2{=}CHSO_2(CH_2)_{n2}SO_2CH{=}CH_2 \qquad \text{(III)}$$

wherein $n_2$ is an integer of 1 to 3.

$$CH_2{=}CH{-}SO_2{-}(CH_2)_a{-}\underset{OH}{(CH)_b}{-}R{-}\underset{OH}{(CH)_c}{-}(CH_2)_d{-}SO_2{-}CH{=}CH_2 \qquad \text{(IV)}$$

wherein a and d are each 1 or 2; b and c are each an integer of 0 to 2 (excluding the case that both a or b and b or c are 0 at the same time); and R is a linking group and is alkylene or arylene containing 1 to 8 carbon atoms.

Of the compounds represented by the foregoing formulae, those represented by formula (IV) are preferred.

Suitable examples of such vinyl sulfone group-containing compounds are as follows:

Compound 1.

$$CH_2{=}CHSO_2CH_2\underset{OH}{CH}CH_2SO_2CH{=}CH_2$$

Compound 2.

$$CH_2{=}CHSO_2CH_2\underset{OH}{CH}CH_2CH_2SO_2CH{=}CH_2$$

Compound 3.

$$CH_2{=}CHSO_2CH_2\underset{OH}{CH}CH_2\underset{OH}{CH}CH_2SO_2CH{=}CH_2$$

Compound 4.

$$CH_2{=}CHSO_2CH_2OCH_2SO_2CH{=}CH_2$$

Compound 5.

$$CH_2{=}CHSO_2CH_2CH_2OCH_2CH_2SO_2CH{=}CH_2$$

Compound 6.

$$CH_2{=}CHSO_2(CH_2)_2SO_2CH{=}CH_2$$

Compound 7.

$$CH_2{=}CHSO_2(CH_2)_2{-}CONH{-}(CH_2)_2{-}NHCO(CH_2)_2SO_2CH{=}CH_2$$

Compound 8.

-continued

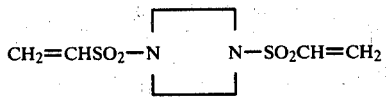

Compound 9.

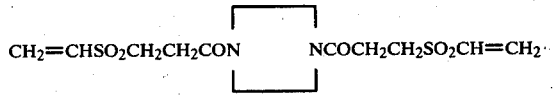

Compound 10.

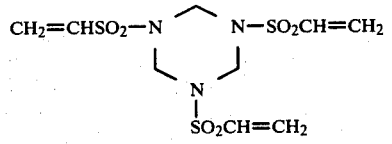

Of these, more preferred examples are Compounds 1 to 6, most preferably Compound 1.

The amount of the vinyl sulfone group-containing gelatin hardener used is about 0.01 to 20% by weight based on the weight of the acid-treated gelatin, with the range of about 0.1 to 10% by weight being particularly preferred.

The backing layer of the invention preferably contains therein a polymer latex for the purpose of increasing dimensional stability.

The polymer latex as used herein is an aqueous dispersion of a water-insoluble polymer having an average grain diameter of about 20 to 200 mμ. The weight ratio (dry basis) of polymer latex to gelatin as a binder is preferably about 0.01:1 to 1.0:1 and particularly preferably about 0.1:1 to 0.8:1.

Preferred examples of polymer latexes which can be used in the invention includes latexes of those polymers comprising a monomer unit of an alkyl, hydroxyalkyl or glycidyl ester of acrylic acid or methacrylic acid and having an average molecular weight of about 100,000 or more, preferably about 300,000 to 500,000. Suitable examples of such polymers are shown below:

Polymer 1

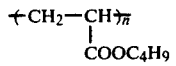

Polymer 2

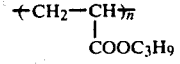

Polymer 3

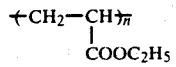

Of these, Polymer 3 is most preferred.

With regard to polymer latexes, U.S. Pat. Nos. 2,852,386, 3,062,674, 3,411,911, 3,411,912 and 3,525,620 can be referred to.

The backing layer of the invention can contain colloidal silica, if necessary. The colloidal silica which can be used in the invention has an average grain diameter of about 7 to 120 mμ and is composed mainly of silicon dioxide. It may contain small amounts of alumina, sodium aluminate, and the like.

The colloidal silica is described in detail, for example, in Egon matijević ed., *Surface and Colloid Science,* John Wiley & Sons, Vol. 6, pp. 3–100 (1973). Examples of such colloidal silicas which are available on the market include Ludox AM, Ludox AS, Ludox LS, Ludox TM, Ludox HS, etc. (produced by E. I. Du Pont de Nemours & Co., U.S.A.) and Snowtex 20, Snowtex C, Snowtex N, Snowtex O, etc. (produced by Nissan Chemical Industry Co., Ltd., Japan).

With regard to the amount of the colloidal silica to be used in the invention, the weight ratio (dry basis) of colloidal silica to gelatin (used as a binder in the backing layer) is preferably about 0.05:1 to 1.0:1, with the range of about 0.2:1 to 0.7:1 being particularly preferred.

The dye to be used in the backing layer of the invention is not critical. Preferred examples of such dyes include oxonol-, benzylidene-, styryl-, triphenylmethane- and anthraquinone-based dyes. Preferred dyes are shown below:

Dye (1)

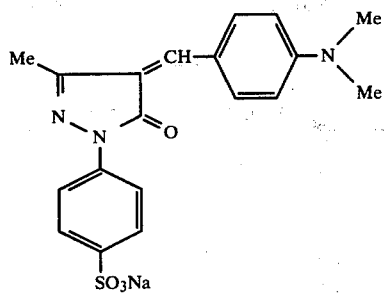

Dye (2)

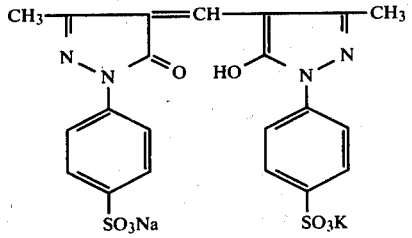

Dye (3)

-continued

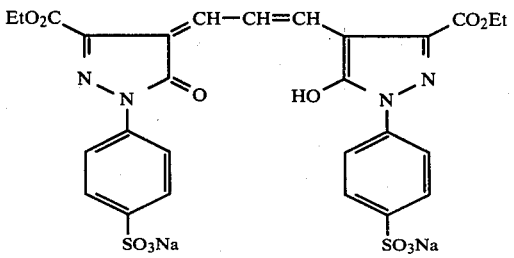

Dye (4)

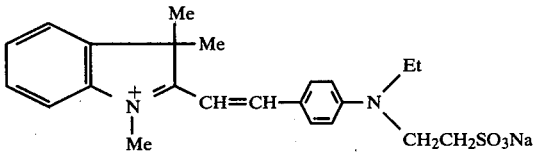

Dye (5)

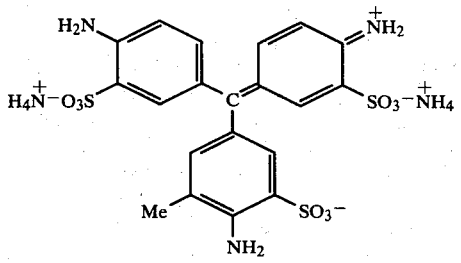

Dye (6)

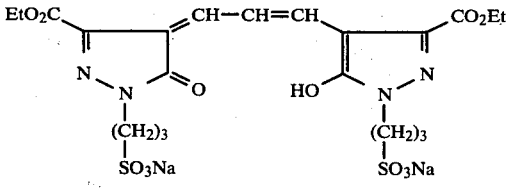

Dye (7)

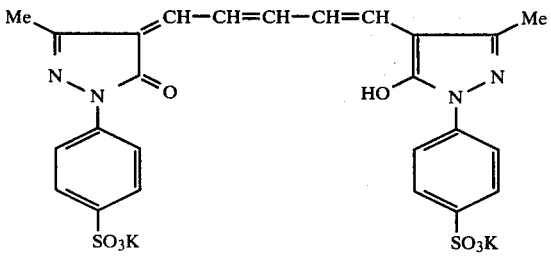

Dye (8)

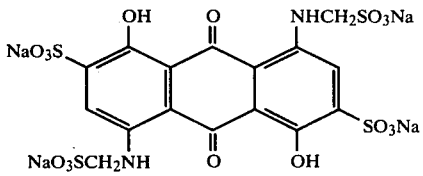

Dye (9)

-continued

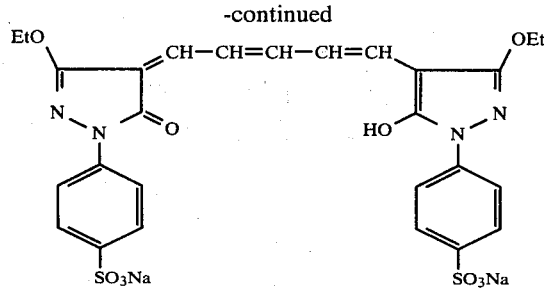

The backing layer of the invention preferably contains a so-called matting agent. As the matting agent, fine particles of organic or inorganic compounds having an average grain diameter of about 0.1 to 10 μm, preferably 1 to 5 μm, can be used. In particular, silicon dioxide and polymethyl methacrylate are preferably used.

The amount of the matting agent used is preferably about 0.1 to 5% by weight based on the weight of the gelatin used in the backing layer, with the range of about 0.2 to 2% by weight being particularly preferred.

The backing layer of the invention may contain a surfactant, if necessary. Any of anionic, cationic, nonionic and amphoteric surfactants can be used. Of such surfactants, anionic surfactants are particularly preferred.

The backing layer of the invention may comprise a plurality of layers. The total thickness of such backing layers is preferably about 1 to 15 μm and more preferably about 3 to 10 μm.

For a backing layer comprising a plurality of layers, the acid-treated gelatin and vinyl sulfone group-containing compound may be incorporated either into all the layers or into only the uppermost layer of the backing layer.

Hereinafter, other elements of the light-sensitive printing medium will be explained briefly.

Preferred examples of supports which can be used include a cellulose acetate film, such as a triacetyl cellulose film, and a polyester film, such as a polyethylene terephthalate film. The thickness of the support is preferably about 30 to 200 μm and more preferably about 70 to 180 μm.

Into a silver halide emulsion layer can be incorporated various additives, such as a chemical sensitizer, a surfactant, a gelatin hardener, a polymer latex, a spectral sensitizer, an antifoggant, and a dot-improving agent, as well as silver halide particles and gelatin.

Not only a so-called lith type emulsion, but also a usual black-and-white silver halide emulsion can be used as the silver halide emulsion. The lith type emulsion is particularly preferred. With regard to the halogen composition of the lith type emulsion, it is preferably a silver chloroiodobromide emulsion containing about 60 mol% or more of silver chloride and about 10 mol% or less of silver iodide.

Particularly preferred examples of surfactants which are used in the silver halide emulsion layer are polyethylene oxide-based nonionic surfactants.

Additives for the silver halide emulsion, etc., are described in, for example, Japanese Patent Application (OPI) Nos. 78426/77, 112314/77, and 3217/78 (the term "OPI" as used herein refers to a "published unexamined Japanese patent application"), Japanese Patent Publication No. 34489/77, U.S. Pat. No. 4,144,069 and *Research Disclosure,* Vol. 176, pp. 22–28 (December, 1978).

A method of developing the light-sensitive printing medium of the invention is subject to no particular limitation. That is, the light-sensitive printing medium can be processed either with a usual black-and-white developer or with a so-called lith type developer. Preferably, the lith type developer contains only dihydroxybenzene, such as hydroquinone, as a developing agent and contains about 5 g/l or less of a sulfurous acid salt.

The development processing can be performed by reference to the foregoing patent specifications and *Research Disclosure,* pp. 28–29.

The following example is given to illustrate the invention in greater detail although the invention is not limited thereto.

The adhesion resistance and color-retention properties were measured as follows:

(1) Adhesion resistance test

A sample was cut into 4 cm×4 cm pieces and a set of two pieces was adjusted in humidity for 24 hours under the conditions of a temperature of 35° C. and a relative humidity of 75% RH. Then, the two pieces were superposed in such a manner that the backing layer of one of the pieces came into contact with the protective layer of the other piece and were allowed to stand under a load of 1 kg for 24 hours under the conditions of a temperature of 35° C. and a humidity of 75% RH. Then, the load was removed and after the separation of the pieces, the total area of bonded areas was measured (in the protective layer, the bonded areas were colored with the dye transferred from the backing layer).

The adhesion resistance was evaluated as follows:

| Rating | Ratio of bonded area to total area (%) |
|---|---|
| A | 0 to 10 |
| B | 11 to 25 |
| C | 26 to 50 |
| D | 51 to 75 |
| E | more than 76% or the pieces cannot be peeled apart because of their strong adhesion |

(2) Color retention properties test

Five pieces were developed, fixed and washed with water without the application of light-exposure and then dried. They were superposed and the absorbance of the superposed pieces was measured. The ratio of absorbance at a wavelength of 650 mμ to absorbance at a wavelength of 550 mμ was calculated.

| Rating | Ratio |
|---|---|
| A | 1.00 to 1.05 |
| B | 1.06 to 1.10 |
| C | 1.11 to 1.15 |
| D | 1.16 or more |

EXAMPLE 1

A silver halide emulsion having Formulation (1) shown below was coated on one side of a 100μ thick polyethylene terephthalate film which had been undercoated, so that the dry thickness and the amount of silver coated were 6.0μ and 5.0 g/m$^2$, respectively. A protective layer having Formulation (2) shown below was provided on the silver halide emulsion layer as provided above. On the opposite side of the polyethylene terephthalate film, a gelatin backing layer having Formulation (3) shown below was provided in a dry thickness of 5μ. Thus, Samples (1) to (3) were obtained.

Formulation (1)

(for the silver halide emulsion layer)

Gelatin: 5 g/m$^2$
Silver chloroiodobromide: Cl: 80 mol%; Br: 19.5 mol%; I: 0.5 mol%
Chloroauric acid: 0.1 mg/m$^2$
Polyethyl acrylate latex (same as used in Example 3 of U.S. Pat. No. 3,525,620): 1.5 g/m$^2$
Sensitizing dye: 3-Allyl-5-[2-(1-ethyl)-4-methyl-2-tetrazolin-5-ylidene-ethylidene]rhodanine: 6 mg/m$^2$
Antifoggant: 4-Hydroxy-6-methyl-1,3,3a,7-tetraazaindene: 30 mg/m$^2$
Polyoxyethylene compound:

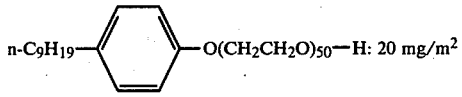

Gelatin hardener: 2-Hydroxy-4,6-dichloro-S-triazine sodium salt: 60 mg/m$^2$
Surfactant: Sodium p-dodecylbenzenesulfonate: 40 mg/m$^2$ Formulation (2)

(for the protective layer)

Gelatin: 1 g/m$^2$
Matting agent: Polymethyl methacrylate having an average grain diameter of 3.0 to 4.0μ: 0.05 g/m$^2$
Surfactant: Sodium p-dodecylbenzenesulfonate: 0.03 g/m$^2$
Gelatin hardener: 2-Hydroxy-4,6-dichloro-S-triazine sodium salt: 0.01 g/m$^2$ Formulation (3)

(for the backing layer)

Gelatin: Shown in Table 1.
Gelatin hardener: Shown in Table 1.
Matting agent*: 0.03 g/m$^2$
Polymer latex**: 50 g/100 g gelatin
Dye***: 0.3 g/m$^2$
*Same as used in Formulation (2).
**Same as used in Formulation (1).
***A mixture of Dye (2):Dye (5):Dye (7)=1:1:1

For the thus-obtained samples, the adhesion resistance and color-retention properties were measured. The results are shown in Table 1.

TABLE 1

| Sample No. | Formulation of Backing Layer: Gelatin (4 g/m$^2$) | Formulation of Backing Layer: Hardener (millimols/100 g/gelatin) | Adhesion Resistance | Color-Retention Properties |
|---|---|---|---|---|
| 1 | Alkali-Treated Gelatin*1 | Comparative Compound 1 | D | B |
| 2 | Alkali-Treated Gelatin*1 | Comparative Compound 2 | D | B |
| 3 | Alkali-Treated Gelatin*1 | Compound 1 | C | A |
| 4 | Acid-Treated Gelatin*2 | Comparative Compound 1 | B | D |
| 5 | Acid-Treated Gelatin*2 | Comparative Compound 2 | B | D |
| 6 | Acid- | Compound 1 | A | A |

TABLE 1-continued

| Sample No. | Formulation of Backing Layer: Gelatin (4 g/m²) | Hardener (millimols/ 100 g/gelatin) | Adhesion Resistance | Color-Retention Properties |
|---|---|---|---|---|
| (invention) | Treated Gelatin*2 | | | |

*1Isoelectric point 4.9
*2Isoelectric point 6.5
Comparative Compound 1: Dimethylol urea
Comparative Compound 2: Monomethylol dimethylhydantoin It can be seen from Table 1 that Sample 6 produced in accordance with the invention is excellent in both the adhesion resistance and color-retention properties as compared with Samples 4 and 5 where hardeners outside the scope of this invention are used.

While the invention has been described in detail and with reference to specific embodiments thereof, it will be apparent to one skilled in the art that various changes and modifications can be made therein without departing from the spirit and scope thereof.

What is claimed is:

1. A method of improving the adhesion resistance of a silver halide photographic light-sensitive medium for use in printing, said medium comprising a support, a silver halide emulsion layer provided on one side of said support, and a backing layer provided on the other side of said support, which comprises incorporating an acid-treated gelatin, a gelatin hardener containing therein a vinyl sulfone group, and a polymer latex having an average grain diameter of about 20 to 200 mμ, into said backing layer.

2. A method as claimed in claim 1, wherein said acid-treated gelatin is produced from animal skin.

3. A method as claimed in claim 2, wherein said animal skin is pigskin.

4. A method as claimed in claim 1, wherein said acid-treated gelatin is produced from animal bones.

5. A method as claimed in claim 4, wherein said animal bones are cow bones.

6. A method as claimed in any one of claims 1 to 4, wherein said acid-treated gelatin has an isoelectric point of pH 6.0 to 7.5.

7. A method as claimed in any one of claims 1 to 4, wherein acid-treated gelatin is contained in said backing layer in an amount of about 0.1 to 20 g per square meter.

8. A method as claimed in claim 7, wherein said acid-treated gelatin is contained in said backing layer in an amount of 0.5 to 6 g per square meter.

9. A method as claimed in claim 1, wherein said gelatin hardener containing said vinyl sulfone group is contained in an amount of about 0.1 to 20% by weight based on the weight of said acid-treated gelatin.

10. A method as claimed in claim 9, wherein said hardener is contained in an amount of about 0.1 to 10% by weight based on the weight of said acid-treated gelatin.

11. A photographic light-sensitive medium for printing, comprising:

a support;

a silver halide emulsion layer provided on a first side of said support; and a backing layer provided on a second side of said support, said backing layer having incorporated therein an acid-treated gelatin, a gelatin hardener containing therein a vinyl sulfone group, and a polymer latex having an average grain diameter of about 20 to 200 mμ.

12. A photographic light-sensitive medium as claimed in claim 11, wherein said acid-treated gelatin is produced from animal skin.

13. A photographic light-sensitive medium as claimed in claim 12, wherein said animal skin is pigskin.

14. A photographic light-sensitive medium as claimed in claim 11, wherein said acid-treated gelatin is produced from animal bones.

15. A photographic light-sensitive medium as claimed in claim 14, wherein said animal bones are cow bones.

16. A photographic light-sensitive medium as claimed in any one of claims 11 to 14, wherein acid-treated gelatin has an isoelectric point of pH 6.0 to 7.5.

17. A photographic light-sensitive medium as claimed in any one of claims 11 to 14, wherein acid-treated gelatin is contained in said backing layer in an amount of about 0.1 to 20 g per square meter.

18. A photographic light-sensitive medium as claimed in claim 17, wherein said acid-treated gelatin is contained in said backing layer in an amount of 0.5 to 6 g per square meter.

19. A photographic light-sensitive medium as claimed in claim 11, wherein said gelatin hardener containing said vinyl sulfone group is contained in an amount of about 0.1 to 20% by weight based on the weight of said acid-treated gelatin.

20. A photographic light-sensitive medium as claimed in claim 19, wherein said hardener is contained in an amount of about 0.1 to 10% by weight based on the weight of said acid-treated gelatin.

* * * * *